US008681046B2

(12) United States Patent
Dumon et al.

(10) Patent No.: US 8,681,046 B2
(45) Date of Patent: Mar. 25, 2014

(54) SYSTEM FOR EMITTING ELECTROMAGNETIC BEAMS, COMPRISING A NETWORK OF ANTENNAE

(75) Inventors: Patrick Dumon, Vigoulet-Auzil (FR); Philippe Garreau, Paris (FR); Marc Le Goff, Bohars (FR); Luc Duchesne, Angervilliers (FR)

(73) Assignees: Microwave Vision (FR); Centre National d'Etudes Spatiales (FR)

( * ) Notice: Subject to any disclaimer, the term of this patent is extended or adjusted under 35 U.S.C. 154(b) by 145 days.

(21) Appl. No.: 13/145,400

(22) PCT Filed: Jan. 19, 2010

(86) PCT No.: PCT/EP2010/050583

§ 371 (c)(1),
(2), (4) Date: Jul. 20, 2011

(87) PCT Pub. No.: WO2010/084116

PCT Pub. Date: Jul. 29, 2010

(65) Prior Publication Data

US 2011/0279320 A1 Nov. 17, 2011

(30) Foreign Application Priority Data

Jan. 20, 2009 (FR) ..... 0950320

(51) Int. Cl.
*H01Q 3/00* (2006.01)

(52) U.S. Cl.
USPC ..... 342/360; 342/368; 342/372

(58) Field of Classification Search
USPC ..... 342/81, 154, 360, 369, 370, 437, 368, 342/372; 343/757, 758
See application file for complete search history.

(56) References Cited

U.S. PATENT DOCUMENTS

| | | | |
|---|---|---|---|
| 4,870,423 | A | 9/1989 | Bolomey |
| 6,163,296 | A | 12/2000 | Lier et al. |
| 2004/0061644 | A1 | 4/2004 | Lier et al. |

FOREIGN PATENT DOCUMENTS

| | | | |
|---|---|---|---|
| DE | 102005011128 | A1 | 9/2006 |

OTHER PUBLICATIONS

International Search Report, PCT/EP2010/050583, dated May 20, 2010.

*Primary Examiner* — Dao Phan
(74) *Attorney, Agent, or Firm* — Lerner, David, Littenberg, Krumholz & Mentlik, LLP

(57) ABSTRACT

This invention relates to a system for emitting electromagnetic beams, comprising a network of elements for the far-field emission of electromagnetic beams, the signals coming from and/or arriving towards each element weighted by excitation coefficients digitally determined by calculation means. According to the invention, the system comprises: a second separate network of sensors arranged close to the network of radiating elements in order to measure the near field radiated by the elements, means for calculating the far field radiated by the network from the near field actually measured by the sensors, and means for calculating the correction of the excitation coefficients of the elements from the difference between the far field calculated from the measurement of the near field and a pre-determined nominal far field.

10 Claims, 3 Drawing Sheets

SYSTEM FOR EMITTING ELECTROMAGNETIC BEAMS, COMPRISING A NETWORK OF ANTENNAE

CROSS REFERENCE TO RELATED APPLICATIONS

The present application is a national phase entry under 35 USC §371 of International Application No. PCT/EP2010/050583, filed Jan. 19, 2010, published in French, which claims the benefit of and priority to French Patent Application No. 0950320, filed Jan. 20, 2009, the entire disclosures of which are incorporated herein by reference.

The invention relates to a large size antenna emission and/or reception system including a network of radiating elements.

BACKGROUND OF THE INVENTION

The field of application of the invention is satellite antennas, radar antennas, aircraft antennas, generally ground-based or on-board antennas integrating networks of radiating elements.

In emission, the radiating elements of the network antenna are fed with electromagnetic signals which are digitally phase-and-amplitude-weighted beforehand with excitation coefficients determined by computing means. In reception, the electromagnetic signals received by elements of the network antenna are then phase-and amplitude-weighted digitally with excitation coefficients determined by these same computing means. These excitation coefficients are used in reception for transforming the signals received by the elements of the network antenna and stemming from one or several directions into a useful coherent signal, and in emission for transforming a useful signal into different signals feeding the elements of the network and forming one or more given illumination beams, in both cases for observing a certain intended illumination law for the network. One skilled in the art will recognize in the digital generation of the excitation coefficients and in the digital weighting of the signals of the elements of the network antenna, a digital network for forming beams (Digital Beamforming Network or DBFN).

One of the problems of large size network antennas is the fact that the arrangement and the orientation of the elements of the network may vary over time.

For example, an orbiting satellite may be subject to sudden changes in temperature according to whether it is illuminated by the sun or not.

The result is deformations of the antenna due to the existence of significant thermal gradients.

Generally, the antenna may be subject to significant thermal and mechanical stresses generating deformations of the latter.

These deformations perturb the illumination law of the elements of the network.

Presently, in order to limit these deformations, it is resorted to mechanical structures supporting the network antenna, the design of which should allow the rigidity, the flatness and the shape of the antenna to be maintained under very severe thermal and mechanical stresses. Consequently, these mechanical supporting structures generally have significant mass, cost and bulkiness.

Presently, the functions for calibrating the elements of the network are generally ensured by using couplers inserted in the emission circuit in order to pick up a portion of the signal sent to the emitting elements.

Another calibration solution consists of conducting remote measurements. For example, on an orbiting satellite, the measurements are carried out from an earth station.

These means are burdensome and costly to apply and the corrections cannot always be made in real time for reasons of logistics and/or cost-effectiveness. Further, many approximations are made during these measurements (mutual couplings between elements not taken into account, behavior of the radiating elements not taken into account, non-exhaustive tests, etc.) This is detrimental to optimum operation of the antennas since the environmental conditions under which the latter are found (high and rapid temperature gradients for example for space antennas, winds for radar, ground antennas, etc.) cause variations in the shape of the network, in the performances of the radiating elements and in the resulting radiation diagram of the antenna. The consequences are designs of antennas with complex and often heavy and bulky mechanical structures.

BRIEF SUMMARY OF THE INVENTION

An object of the invention is to overcome these drawbacks by proposing a network antenna system allowing a desired illumination law and radiation diagram to be observed as much as possible.

Another object of the invention is to obtain a network antenna system which is less burdensome to apply.

Another object of the invention is to allow real-time control of each of the elements of the antenna and of the far field radiation diagram.

A first subject matter of the invention is a system for emitting electromagnetic beams, including a network of elements for emitting far field electromagnetic beams, the signals stemming from and/or arriving at each of the elements being weighted by excitation coefficients digitally determined by computing means, characterized in that the system includes:

- a second distinct network of sensors laid out in proximity to the network of radiating elements in order to measure the existing near field radiated by the elements,
- means for computing the far field radiated by the network from the near field actually measured by the sensors,
- means for computing corrections of the excitation coefficients of the elements from the difference existing between the far field, computed from the measurement of the near field and a predetermined set far field.

By means of the invention, the illumination law of the network is controlled in real time from local measurements of the near field radiated by the latter, thereby allowing rapid reconfiguration of the beams. The system thereby includes on-board monitoring means with which the radiation diagram of the network antenna may be checked in real time. This allows adjustment and real-time compensation of the radiation diagram of the antenna in the case of deformation of the network or else of a failure of one or more elements of the network. The emission and reception radiation diagrams of the antenna are corrected in real time by acting on the values of the excitation coefficients of each of the elements of the network. The system allows the mechanical and thermal deformations to which the antenna may be subject, to be taken into account and which may be non-negligible with respect to the Ku or Ka band wavelength for an orbiting satellite, for example.

This will subsequently allow relaxation of certain manufacturing constraints for large size network antennas and their supporting means, notably in the space medium, and reduction in the mass and the cost of the antennas and of the system.

Thus, some deformability of the network antenna and of its supporting means may be accepted under the effect of external conditions, while being aware that the on-board control of the illumination law of the antenna and the calculations for correcting the excitation coefficients will allow compensation of this real-time deformation.

Thus, according to an embodiment, the radiating elements of the network are attached to a first support, the second network of sensors being attached to a second support distinct from the first support, the first support and the second support being attached to a common base with a space between the first support and the second support allowing deformation of the first support.

According to other embodiments of the invention:

The first support comprises a common plate for supporting the radiating elements of the network, and a second support is provided for each sensor, this support for each sensor including a holding rod, one end of which is attached to the sensor and the other end of which is attached to a base, to which the first support is also attached via spacers, the plate including holes for the crossing of the rods with said space present between the edge of the hole and the rod.

The sensors are positioned in the free space and distributed above the plane of the network of radiating elements.

The height between the sensors and the radiating elements of the network is greater than a fraction of the working wavelength of the elements.

The excitation coefficients comprise a phase shift and an amplitude, the system includes for each element of the network an associated reception channel and/or an associated emission channel, the computing means being provided for calculating the phase shift adjustments of the excitation coefficients and the amplitude adjustments of the excitation coefficients so that the radiation diagram measured from the sensors is as close as possible to radiation diagram of a set instruction.

The system includes means for addressing the sensors in order to collect the near field measurement locally at the location of each sensor by using a modulated broadcasting technique for example.

The invention will be better understood upon reading the following description, only given as a non-limiting example with reference to the appended drawings, wherein:

DETAILED DESCRIPTION

Figure 1:
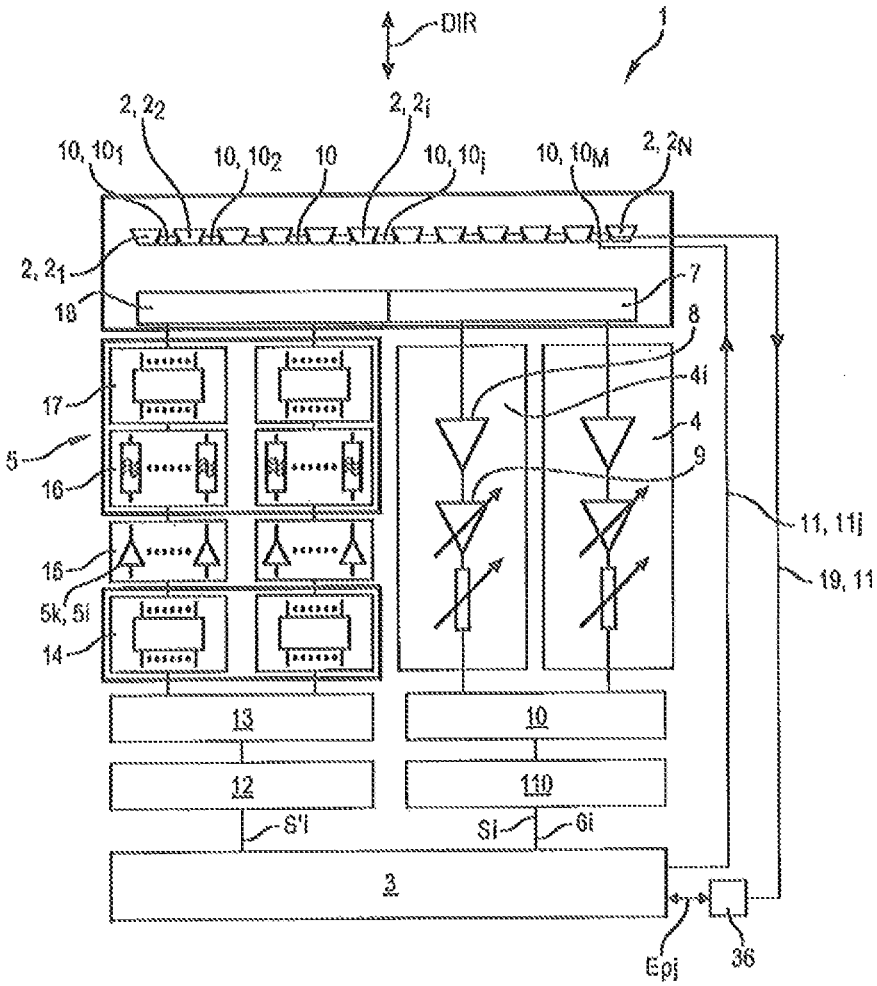
FIG. 1 illustrates a modular block diagram of an exemplary emission and reception antenna system according to the invention.

The invention is described below in the example of a satellite network antenna, responsible for retransmitting to Earth a signal received from an earth base station.

The emission and reception system 1 includes a network 2 of a plurality of radiating elements $\mathbf{2}_1, \mathbf{2}_2, \ldots \mathbf{2}_i, \ldots \mathbf{2}_N$. This network 2 is for example arranged on a plane. Each element $\mathbf{2}_i$ is for example in the form of a horn or a printed element having an aperture oriented towards a direction DIR common to all the antennas $\mathbf{2}_i$.

The network 2 of antennas is connected to a computer 3 via a reception circuit 4 on the one hand and through an emission circuit 5 on the other hand. The separation between the reception and emission channels is achieved by means of a set 7 of frequency diplexers placed close to the radiating elements.

The reception circuit 4 includes a reception channel 4*i* for processing each signal $s_i$ received on each antenna $\mathbf{2}_i$ and for bringing it onto an input 6*i* of the computer 3. The processing of each reception channel 4*i* comprises, as this is known, a frequency diplexing stage 7, a low noise amplification stage 8, a variable gain amplification stage 9, a base band stage 10 and an analog/digital conversion stage 110.

The emission circuit 5 includes an emission channel 5*i* for each element $\mathbf{2}_i$ of the network 2 and allows forwarding of a signal $s'_i$ to be emitted by the elements $\mathbf{2}_i$ of the network 2. The processing of each emission channel $\mathbf{5}_i$ comprises, as this is known, a digital/analog conversion stage 12, a carrier frequency switching stage 13, a stage 14 for distribution through Buttler matrices, an amplification stage 15, a filtering stage 16, a stage 17 for recombination through Buttler matrices and a frequency diplexing stage 18.

The computer 3 includes means 30*a* for computing the complex excitation coefficients of the antennas $\mathbf{2}_i$ in reception and means 30*b* for computing the complex excitation coefficients of the antennas $\mathbf{2}_i$ in emission.

Therefore there is a complex excitation coefficient Ki for each antenna $\mathbf{2}_i$ in reception and a complex excitation coefficient Lk for each antenna $\mathbf{2}_i$ in emission. The excitation coefficients Ki and Lk respectively allow reconstruction from signals $s_i$ received by the antenna $\mathbf{2}_i$, of a useful coherent signal S, and this useful signal S may be sent back as the signal $s'_k$ to each emission channel 5*k* by forming the desired emission beams. The excitation coefficients Ki and Lk provide a gain and a phase shift, i.e. a complex multiplicative factor or complex weighting, respectively to each reception channel 4*i* with respect to the other reception channels 4*i*, and to each emission channel 5*k* with respect to the other emission channels 5*k*. In a way known to one skilled in the art, the complex values of the reception coefficients Ki are optimized and digitally computed by the computing means 35 of the computer 3 in order to maximize the coherent signal stemming from the sum weighted by the Ki coefficients of the received signals $s_i$.

The means 35 of the computing means 30*a*, depending on the reception signals $s_i$ of the antennas $\mathbf{2}_i$, produce a signal S equal to the weighted sum of the signals $s_i$, weighted by the excitation coefficients Ki according to the equation:

$$S = \sum_{i=1}^{N} Ki \cdot s_i$$

According to the invention, sensors $\mathbf{10}_1, \mathbf{10}_2, \ldots, \mathbf{10}_j, \ldots \mathbf{10}_M$ measuring the near field radiated by the elements $\mathbf{2}_i$, M being able to be different from N and being generally greater than the number N of elements $\mathbf{2}_i$, are provided in proximity to the network 2 of radiated elements $\mathbf{2}_i$.

The network of the sensors 10 is connected through addressing, collecting and receiving means 11 to the computing means 30*b* of the computer 3.

Figure 2:
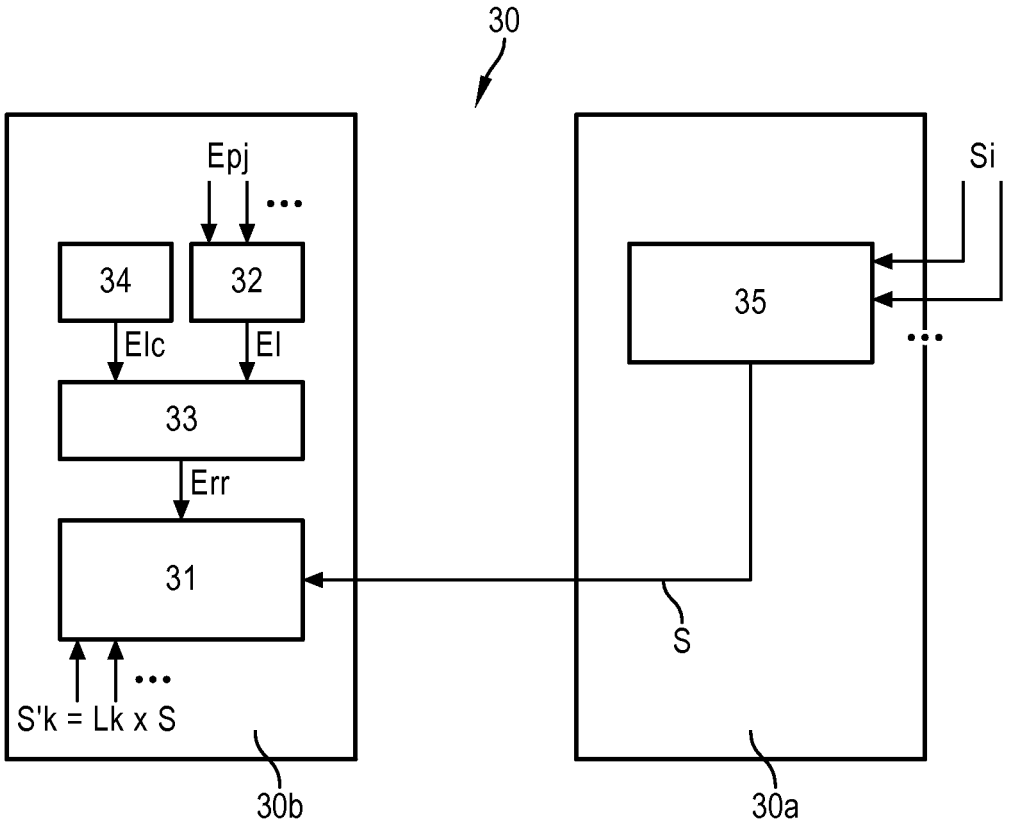
FIG. 2 illustrates a modular block diagram of a regulation portion of the antenna system according to FIG. 1.

The means 30*b* for computing the complex excitation coefficient Lk in emission are illustrated in FIG. 2.

The computing means 30*b* includes a module 31 for determining the excitation coefficients Lk from the near field Epj measured by the sensors $\mathbf{10}_j$.

Each sensor $\mathbf{10}_j$ is used for measuring the near field Epj radiated by the network 2 of radiating elements $\mathbf{2}_i$. An addressing, collecting and receiving means 11 is provided between each sensor $\mathbf{10}_j$ and a module 32 for computing the far field. The module 32 computes the existing far field El from the near field Epj measured by the sensors $\mathbf{10}_j$. The module 32 for example has for this purpose advanced algorithms for computing the far field from data in planar near fields, tables of pre-recorded values of the radiation diagram of the sensors $\mathbf{10}_j$ and elements $\mathbf{2}_i$ and/or other pre-recorded correspondence rules, a memory being provided for this purpose.

A comparator 33 compares this computed existing far field E1 with a pre-determined and pre-recorded set far field Elc, for example in a module 34. The comparator 33 thus computes a far field error signal Err depending on the difference between the computed existing far field El and the set far field Elc. The computing module 31 determines by means of advanced optimization algorithms the excitation coefficients Lk of the elements $\mathbf{2}_i$ from this error signal Err in the far field. The signal S is sent from the module 35 of the portion 30*a* when it is provided or from a generator of a signal S to be emitted to the computing module 31. The excitation coefficients Lk are applied to the signal S to be emitted over the different emission channels 5*k* by the module 31 in order to form the signals $s'_k$.

$$s'_k = L_k \cdot S$$

The module 31 modifies the emission field radiated by the elements $\mathbf{2}_i$, which will again be measured by the sensors 10. Thus, the far field radiated by the elements $\mathbf{2}_i$ is optimized by acting on the coefficient Lk in order to be closer to the ideal field Elc or to be equal to the latter. The far field radiated by the elements $\mathbf{2}_i$ is therefore regulated so as to be closer or equal to the ideal far field Elc.

Of course, there may be more or less radiating elements used in emission as compared with reception, the number of emitting elements used may be different from the number of receiving elements used. Of course, the system may only operate in emission. In the foregoing, the index i relates to the elements used in reception, is less than or equal to the number N of elements of the network 2, and k relates to the elements used in emission, less than or equal to the number N of elements of the network 2. In a satellite, the system operates in reception and in emission, i.e. as a transponder, where the received signal is retransmitted. If the system does not operate as a satellite transponder, but mainly in emission, such as for example for a radar, in which the signal is emitted, an echo signal is received which is processed separately, while the signal S stems from a signal generator and the block 30*a* becomes a source of a digital signal S.

Figure 3:
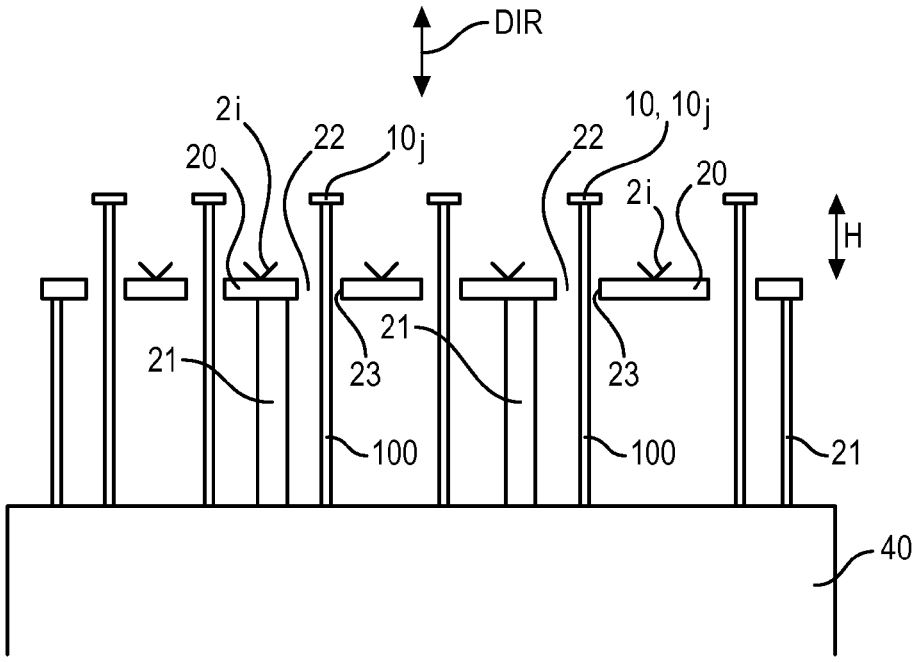
FIG. 3 illustrates a side view of an exemplary portion of the network of elements of the antenna system according to FIG. 1.

In FIG. 3, the plurality of radiating elements $\mathbf{2}_i$, symbolized by two lines in FIG. 3, is attached on a same first support 20, while the plurality of sensors $\mathbf{10}_j$ is attached to another second support 100, different from the first support 20. The first support 20 is for example formed by a same planar plate. For example a second support 100 is provided for each sensor 10. This support 100 is for example formed by a holding rod, one end of which is attached to the sensor $\mathbf{10}_j$ and the other end of which is attached to a stable and rigid base 40 which may be the platform of the satellite, to which the first support 20 is also attached via spacers 21. The sensors $\mathbf{10}_j$ are positioned in the free space in front of the plane of the network of radiating elements $\mathbf{2}_i$, for example by being located in a same geometrical plane parallel to the plane in which are arranged the elements $\mathbf{2}_i$ of the network 2. The height H between the sensors 10 and the elements $\mathbf{2}_i$, for example perpendicularly to the plane on which the elements $\mathbf{2}_i$ are arranged, is for example greater than one fifth of the working wavelength λ of the elements $\mathbf{2}_i$.

FIG. 3 shows that the sensors $\mathbf{10}_i$ are provided on the side and between elements $\mathbf{2}_i$. There exists a space 22 between the first support 20 of the elements $\mathbf{2}_i$ and each second support 100 of the sensors $\mathbf{10}_j$. In FIG. 3, the plate forming the first support 20 includes holes 23 for letting through the second supports 100 therein. Therefore, each second support 100 passes through a hole 23 of the plate forming the first support 20 with the space 22 present between the edge of the hole 23 and the support 100. The space 22 therefore allows clearance between the support 20 and the support 100. This clearance permitted by the spaces 22 allows the first support 20 to deform to a certain extent because of thermal or mechanical strengths for example. The deformation of the support 20 will be taken into account by the sensors $\mathbf{10}_j$ because these sensors $\mathbf{10}_j$ will measure the near field Epj radiated by the elements $\mathbf{2}_i$. Therefore this deformation may be corrected in real time. It will therefore be possible to impose much less strict requirements to the first support 20 and accept to a certain extent deformation of the latter, which will allow lightening of this support 20 and of the means 21 for connecting to the base 40.

Figure 4:
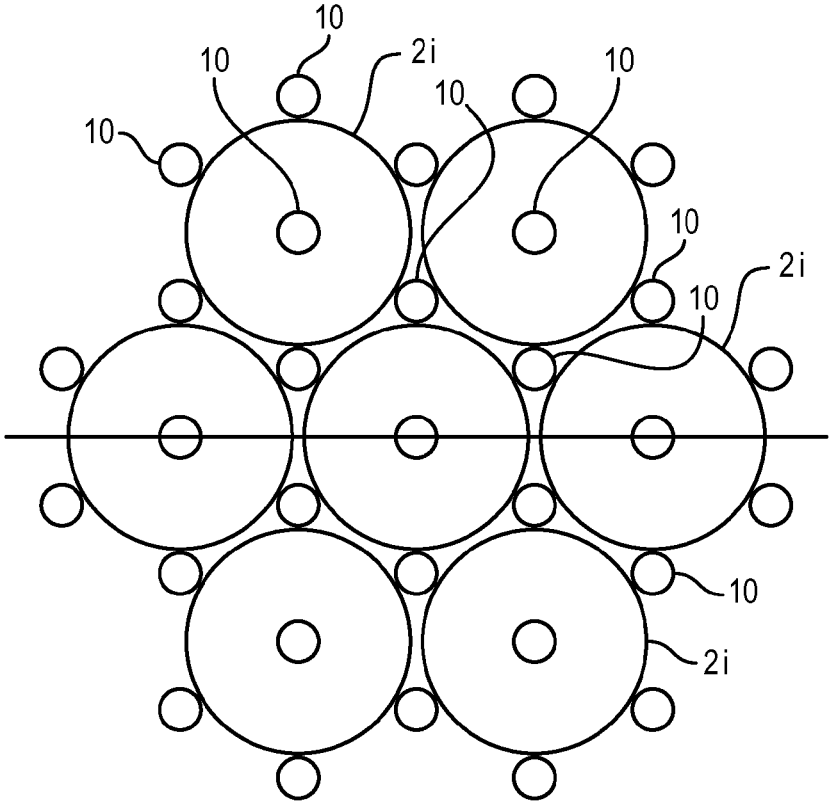
FIG. 4 illustrates a top view of another exemplary portion of the network of elements of the antenna system according to FIG. 1.

FIG. 4 shows that several sensors $\mathbf{10}_j$ may be provided around and between each radiating element $\mathbf{2}_i$, such as for example 6 in number per elements $\mathbf{2}_i$ in the illustrated hexagonal configuration. Further, a sensor $\mathbf{10}_j$ may be provided above each element $\mathbf{2}_i$, as this is also illustrated in FIG. 4. In this case, the support 100 of the sensor 10 located above the element $\mathbf{2}_i$ passes through both the first support 20 and this element $\mathbf{2}_i$.

The sensors 10 are very discreet because of their small size and because they do not perturb the field radiated by the network antennas 2. Modulated broadcasting techniques may be applied to the sensors 10 for locally measuring the near field radiated by the network antennae 2.

FIG. 1 illustrates an embodiment of a system of sensors 10 using the modulated broadcasting technique for conducting measurements of the near field Epj locally at the location of the sensors. For this purpose, the system includes a bus $\mathbf{11}_j$ for addressing the sensors $\mathbf{10}_j$ from the computer 3 and another channel 19 for collecting measurements of the near field Epj from the sensors towards a measurement reception module 36. Because, in order to address one of the sensors $\mathbf{10}_j$, the addressing signal sent by the computer 3 on the bus $\mathbf{11}_j$ is modulated for this sensor $\mathbf{11}_j$, with for example a modulation different from one sensor to the other in order to identify the responses of the sensors to this modulation over the collecting channel 19. The measurement signal Epj collected by the module 36 over the collecting channel 19 and having the modulation sent to the sensor $\mathbf{11}_j$, will be the one provided by this sensor $\mathbf{11}_j$. After having been digitized beforehand, the module 36 will provide different near field measurements Epj to the means 30*b*.

The sensors 10 may be calibrated by receiving a far field calibration signal in the direction DIR, for example from the Earth for a satellite. This calibration may be periodic, for example once a month or a week or other. In the case of a satellite, an earth base station illuminates the satellite with plane waves. By this means, the complex correction coefficients of each sensor 10 are determined so that the amplitude and phase responses of the sensors are uniformized, and also the radioelectric axes of each sensor are orthogonal per sensor and parallel with each other.

The invention claimed is:

1. A system for emitting electromagnetic beams, including a first network of elements for emitting far field electromagnetic beams, the signals stemming from and/or arriving at each of the elements being weighted by excitation coefficients digitally determined by computing means, comprising:

a second distinct network of sensors which is distinct from the first network of elements and which is laid out in proximity to the first network of elements in order to measure the existing near field radiated by the elements, means for computing the far field radiated by the first network from the near field actually measured by the sensors, means for computing corrections of the excitation coefficients of the elements from the difference which exists between the far field computed from the measurement of the near field and a pre-determined set far field, the elements of the first network being attached to a first support, each sensor being attached to a second support distinct from the first support, the first support and the second support being attached to a common base with a space between the first support and each second support, the first support comprising a common plate supporting the elements of the first network, the plate including holes for the crossing of the second support with said space present between the edge of the hole and the second support, said space allowing deformation of the first support.

2. The system according to claim 1, wherein the second support for each sensor includes a holding rod, one end of which is attached to the sensor and the other end of which is attached to the base, to which the first support is also attached via spacers, the plate including holes for letting through the rods, with said space present between the edge of the hole and the rod.

3. The system according to claim 1, wherein the sensors are provided on the side and between elements.

4. The system according to claim 1, wherein several sensors are provided around and between each element.

5. The system according to claim 1, wherein one of the sensors is provided above each element, the second support of this sensor is provided above each element crossing the first support and said element.

6. The system according to claim 1, wherein the sensors are positioned in the free space and distributed above the plane of the first network of elements.

7. The system according to claim 6, wherein the height between the sensors and the elements of the first network is greater than a fraction of the working wavelength of the elements.

8. The system according to claim 7, wherein the height between the sensors and the elements of the first network is greater than one fifth of the working wavelength of the elements.

9. The system according to claim 1, wherein the excitation coefficients comprise a phase shift and an amplitude, the system includes for each element of the first network an associated reception channel and/or an associated emission channel, the computing means being provided for computing the phase shift adjustments of the excitation coefficients and the amplitude adjustments of the excitation coefficients so that the measured radiation diagram from the sensors is as close as possible to a radiation diagram of a set instruction.

10. The system according to claim 1, further comprising means for addressing the sensors and for collecting the near field value measured locally at the location of each sensor by using the modulated broadcasting method.

* * * * *